US005992097A

United States Patent [19]

Makiuchi et al.

[11] Patent Number: 5,992,097

[45] Date of Patent: Nov. 30, 1999

[54] SLIDING DOOR STRUCTURE

[75] Inventors: Kazuya Makiuchi; Mamoru Nishihira; Kunihiko Hisamoto; Masaji Hirano, all of Sagamihara; Masakatsu Tsubouchi, Toyota; Ryoichi Fukumoto, Nagoya; Tsuyoshi Kamiya, Chiryu, all of Japan

[73] Assignee: Aisin Seiki Kabushiki Kaisha, Kariya, Japan

[21] Appl. No.: 09/079,410

[22] Filed: May 15, 1998

[30] Foreign Application Priority Data

May 16, 1997 [JP] Japan ..... 9-127476
May 19, 1997 [JP] Japan ..... 9-128931

[51] Int. Cl.[6] ..... E05D 15/10

[52] U.S. Cl. ..... 49/216; 49/209

[58] Field of Search ..... 49/208, 209, 211, 49/213, 214, 215, 216, 218, 221, 223, 375

[56] References Cited

U.S. PATENT DOCUMENTS

| | | | |
|---|---|---|---|
| 4,530,184 | 7/1985 | Chikaraishi et al. | 49/213 |
| 4,662,109 | 5/1987 | Yui et al. | 49/214 |
| 4,869,544 | 9/1989 | Anwyll et al. | 49/214 X |
| 5,243,785 | 9/1993 | Nieboer et al. | 49/375 |

FOREIGN PATENT DOCUMENTS

| | | |
|---|---|---|
| 5-65025 | 3/1993 | Japan . |
| 6-278459 | 10/1994 | Japan . |

*Primary Examiner*—Jerry Redman
*Attorney, Agent, or Firm*—Burns, Doane, Swecker & Mathis, LLP

[57] ABSTRACT

A sliding door structure for opening/closing a sliding door by guiding it to slide has a guide rail having a component for sliding the slide door upwardly and an insert hole for facilitating an insertion of a roller into an inside space of the guide rail.

8 Claims, 11 Drawing Sheets

SLIDING DOOR STRUCTURE

BACKGROUND OF THE INVENTION

The present invention relates to a sliding door structure for a sliding door adapted to be equipped with a body of a vehicle.

In the prior art, a sliding door to be slid when opened/closed is generally adopted as a rear door of a vehicle such as a light van.

In order to slide this door, there is mounted on the vehicle body a guide rail means composed of three upper, center and lower guide members. The upper rail, as located at the highest position, is mounted inside of the vehicle. This upper rail is connected to the sliding door by an arm extending from the sliding door, and a roller as supported at the leading end of the arm is guided by the upper rail.

As shown in FIG. 11, in order that a roller 118 supported at the leading end of an arm 116 may be inserted into an upper rail 114, it is inserted into an opening which is formed in the upper rail 114 at the side of the fully open end of the sliding door, and the opening is shut of f with a cover which is equipped with the (not-shown) door stopper. As a result, the roller insert hole has to be formed outside of the sliding range of the roller, and a space for passing the roller 118 has to be formed in the body opening near the trailing end of the rail, so that the degree of opening of a sliding door 112 is limited.

Further, as being apparent from FIG. 11, the guide rail 114 extends straight toward a compartment space S which is defined by a roof head lining 120 so that a compartment space becomes narrower and is limited.

In addition to the above, when the opening of the vehicle's body is opened by the sliding door, the sliding door must move only outwardly of the body at least to the extent of the size of the body thickness, but also a straight movement of the sliding door.

To this end, the front end portion of the upper rail must be considerably curved inwardly of the vehicle's body so that it may be further protruded into the compartment space.

SUMMARY OF THE INVENTION

The invention has been conceived to eliminate the above-specified disadvantages and has an object to provide a sliding door structure capable of enlarging a compartment space by preventing the overhang which might otherwise be caused into the compartment space by the housing for a guide rail such as the upper rail.

Another object of the invention is to provide a sliding door structure capable of preventing a roller from coming out from the guide rail by a single action while retaining the degree of opening of the sliding door by forming a roller insert hole in the sliding range of the roller.

According to a first aspect of the invention, there is provided a sliding door structure for opening/closing a sliding door by guiding it to slide, comprising: a guide rail extended in the sliding direction of the sliding door and curved to have a component for guiding the sliding door in a direction to intersect the sliding direction; a rocking arm supported at its root end by the sliding door in a manner to rock in the direction intersecting the sliding direction and guided at its leading end by the guide rail; and bias means for biasing the rocking arm in the direction intersecting the sliding direction.

As a result, the sliding door is opened/closed while being guided to slide by the guide rail, and the guide rail has the component which is curved to make a guidance in the direction intersecting the sliding direction. The rocking arm is biased to follow that component by the bias means. As a result, even if the sliding door is largely protruded when opened from the vehicle body, the overhang of the housing for the guide rail into the compartment space can be prevented to enlarge the compartment space.

According to a second aspect of the invention, there is provided a sliding door assembling structure comprising: a sliding door adapted to slide when opened/closed with respect to a vehicle body; a roller supported turnably on the sliding door; a guide rail extended in the sliding direction of the sliding door for guiding the roller while housing it and having an insert hole opened for insert the roller therethrough; and a clip removably mounted on the guide rail for shutting off the insert hole of the guide rail.

As a result, the roller is inserted through the insert hole of the guide rail so that the sliding door is opened/closed while the roller being guided by the guide rail. The insert hole is shut off when the clip is removably mounted on the guide rail.

Even when the height of the rail section is reduced or when the arm can be turned to swing, the insert hole is shut off with the clip after the roller was inserted through the insert hole, so that the roller is prevented from coming out from the insert hole.

By adopting the small member or the clip, it is possible with a small space to prevent the roller from coming out from the guide rail. By this simple work of mounting the clip, the roller can be prevented from coming out to improve the workability and lower the production cost. In accordance with this, moreover, the roller can be easily replaced by another merely by removing the clip thereby to improve the maintainability.

DESCRIPTION OF THE PREFERRED EMBODIMENTS

A sliding door opening/closing structure according to one embodiment of the invention will be described with reference to FIGS. 1 to 5.

Figure 1:
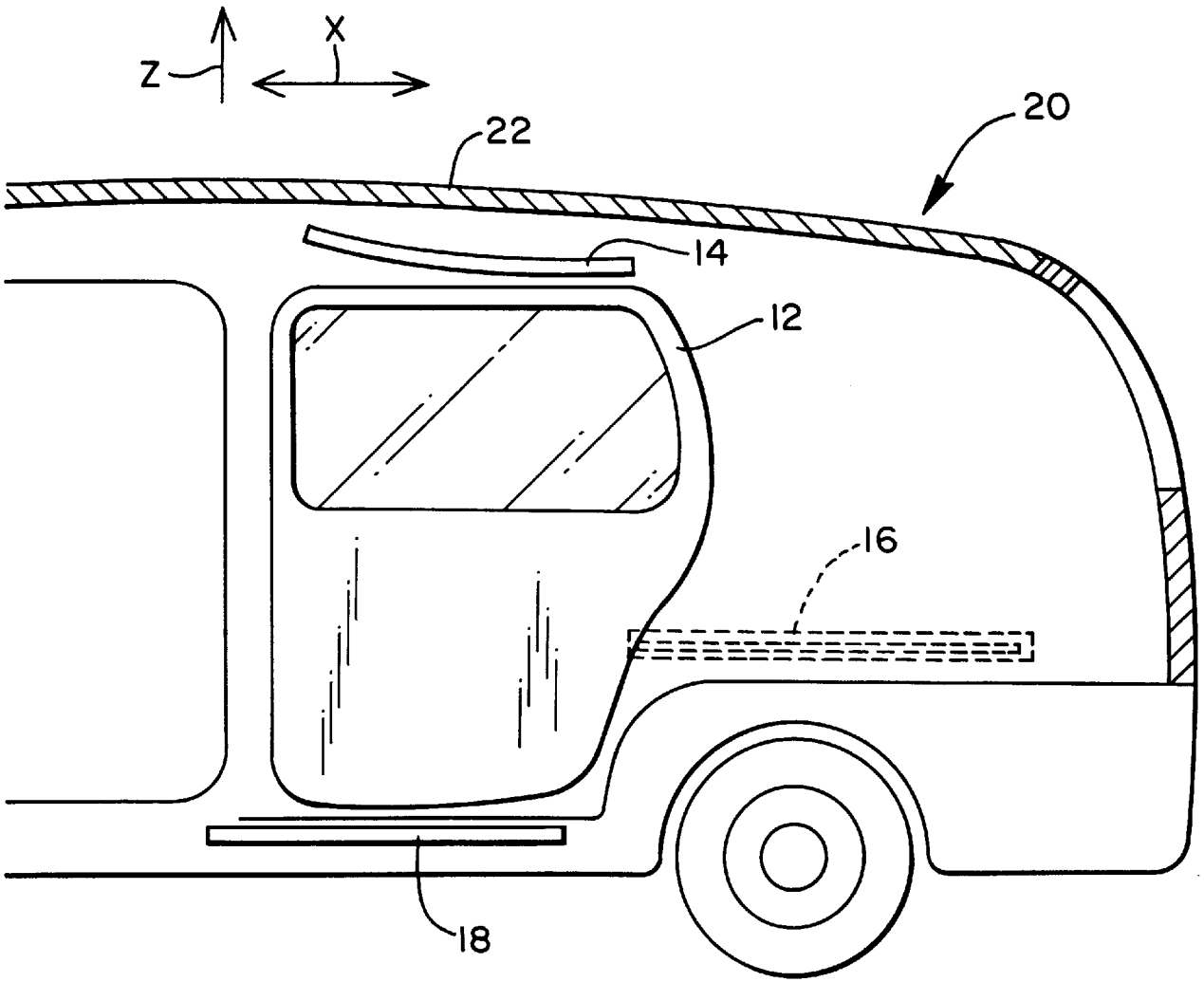
FIG. 1 is a section showing a vehicle to which a sliding door opening/closing structure according to one embodiment of the invention is applied.
Figure 2:
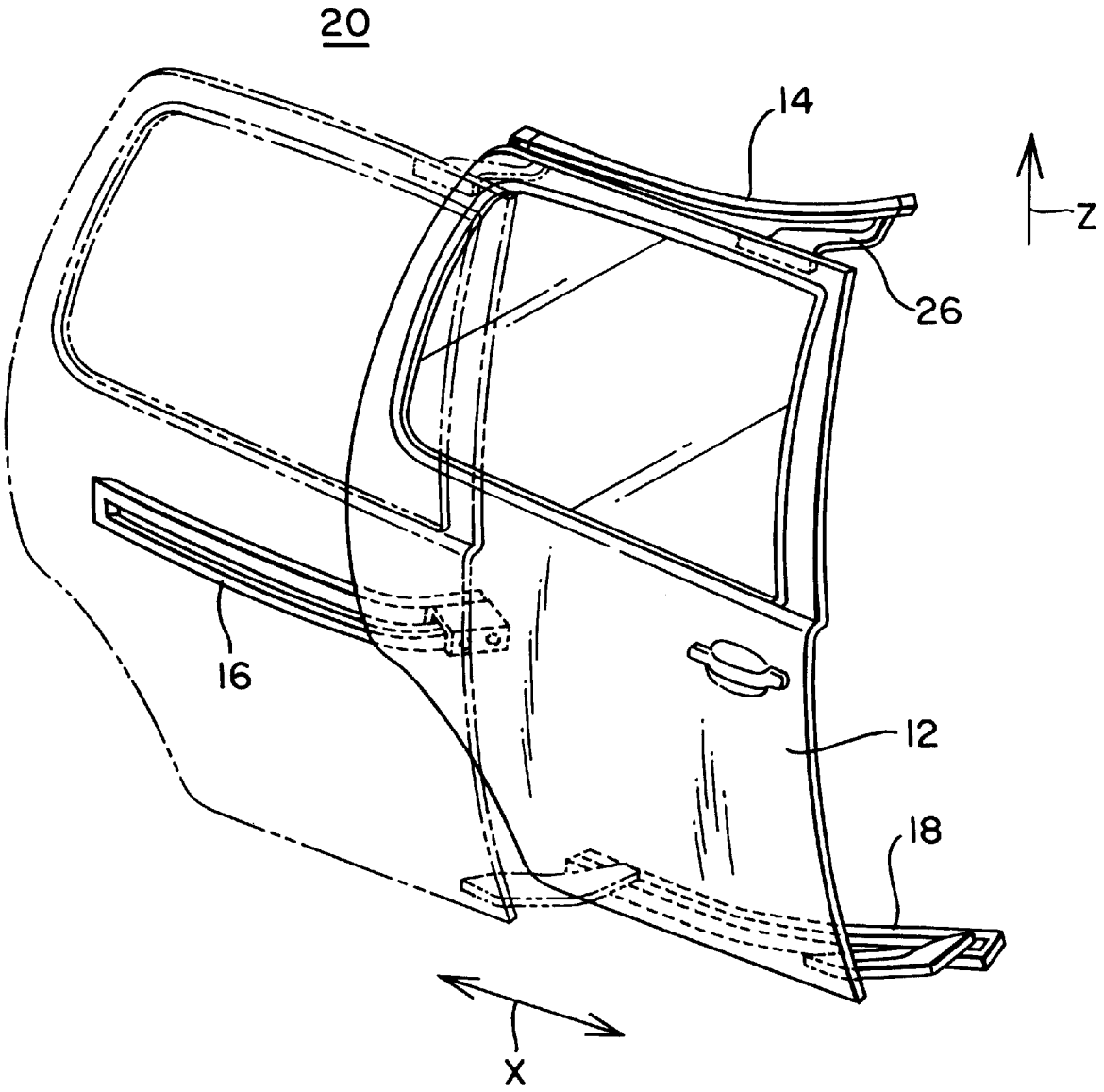
FIG. 2 is a perspective view for explaining the opening/closing operations of the sliding door, to which the sliding door opening/closing structure according to the embodiment of the invention is applied, and shows a closed state in solid lines and an opened state in two-dotted lines.

As shown in FIGS. 1 and 2, a sliding door structure, to which the embodiment is applied, is composed of an upper rail 14, a center rail 16 and a lower rail 18, which are mounted downward in the recited order on the body of a vehicle 20 and opposed to the inner face of a sliding door.

These upper rail 14, center rail 16 and lower rail 18 are formed to extend horizontally in the longitudinal direction (or X-direction), along which the sliding door 12 slides, of the vehicle 20. In order that the sliding door 12 may move, when opened, outward of the vehicle body by at least its thickness. The portions of the upper rail 14 as located closer to the front of the vehicle 20, the center rail 16 and the lower rail 18 are curved inward of the vehicle 20.

Figure 3:
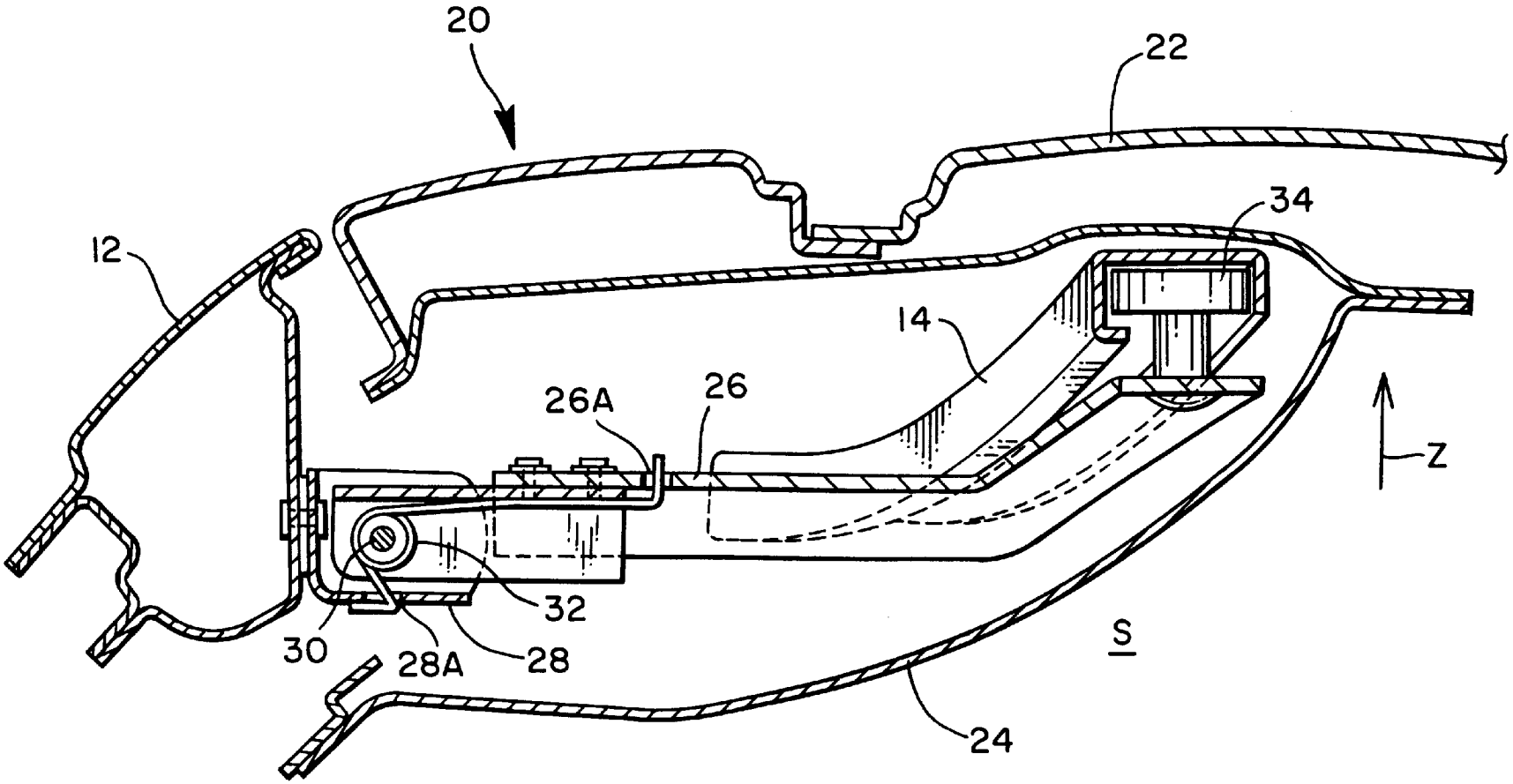
FIG. 3 is an enlarged section showing the sliding door opening/closing structure according to the embodiment of the invention.

Moreover, the upper rail 14 is formed to have a C-shaped section as shown in FIG. 3, and is arranged in a space between a roof 22 of the vehicle 20 and a roof head lining 24 defining the inner wall of a compartment space S. The portion of the upper rail 14 closer to the front of the vehicle 20 is curved to have a component for guiding the sliding door 12 upwardly (or Z-direction) which intersects the sliding direction (or the X-direction) of the sliding door 12. In short, the upper rail 14 or the guide rail is formed to rise in the forward direction of the vehicle 20 (refer to FIGS. 1 and 2).

On the other hand, the sliding door 12 is equipped with sliding members for engaging with those upper rail 14, center rail 16 and lower rail 18 so that it may be guided to slide by the rails 14, 16 and 18. As a result, the sliding door 12 is slid when opened/closed while being guided in the sliding direction or longitudinally of the vehicle 20 by the upper rail 14, the center rail 16 and the lower rail 18.

Figure 4:
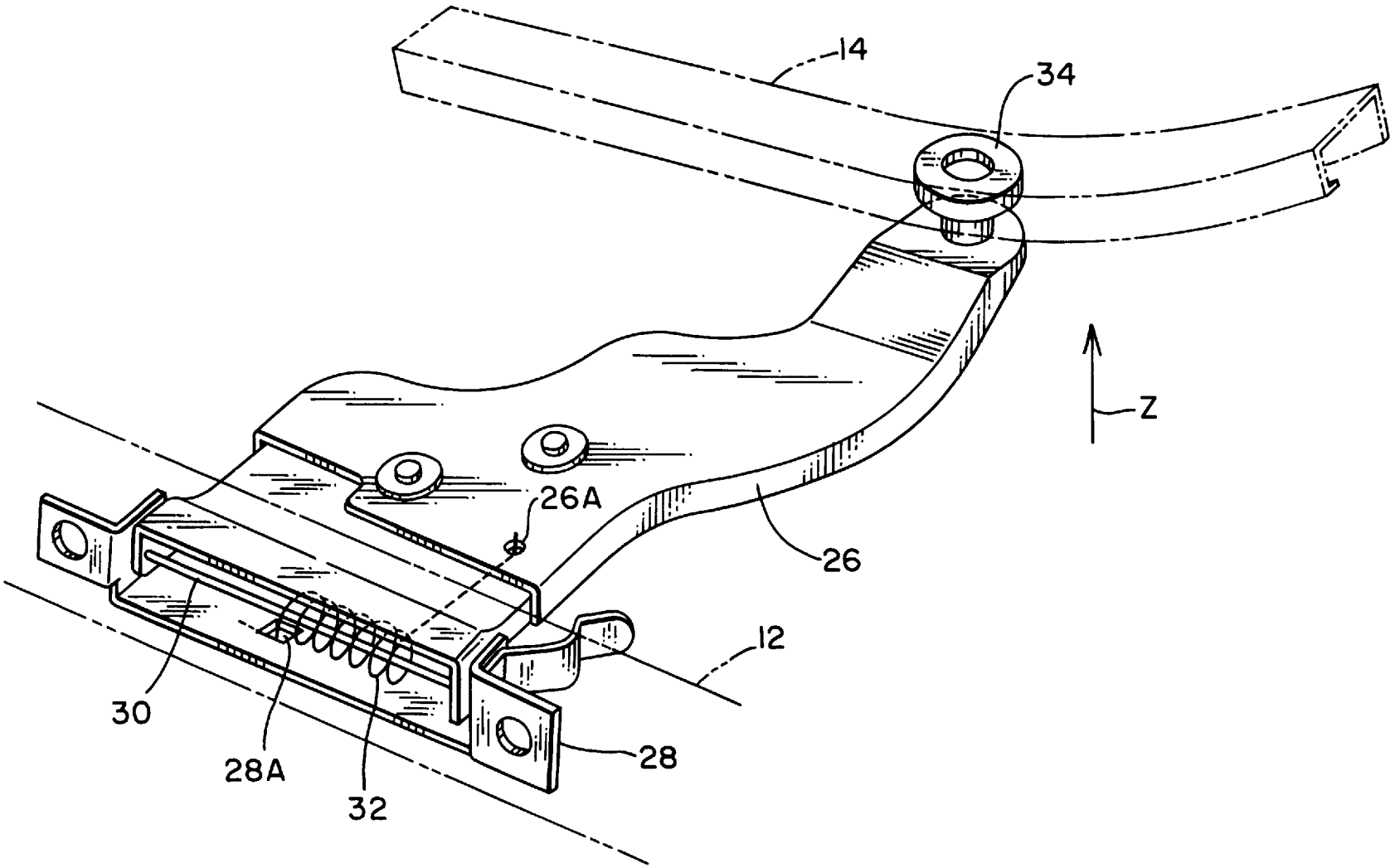
FIG. 4 is an enlarged perspective view showing the sliding door opening/closing structure according to the embodiment of the invention.

As shown in FIGS. 3 and 4, a rocking arm 26 or a sliding-member corresponding to the upper rail 14 is so supported at its root side through a support pin 30 by a base bracket 28 riveted or screwed on the sliding door 12 as to rock vertically. On this support pin 30, there is wound a torsional coil spring 32 or an elastic member acting as bias means. This torsional coil spring 32 is retained at its one end in a hole 28A formed in the base bracket 28 and at its other end retaining in a hole 26A formed in the rocking arm 26. As a result, the rocking arm 26 is always biased upward by the biasing force of the torsional coil spring 32 which is mounted at the root side thereof.

On the leading end of the rocking arm 26, there is turnably supported a roller 34 which is fitted in the upper rail 14 having the C-shaped section, so that the leading end of the rocking arm 26 is guided in slidable engagement with the upper rail 14.

The action of this embodiment will be described.

The upper rail 14 is extended in the sliding direction of the sliding door 12 and is curved to have the component for guiding the sliding door 12 upward or in the direction to intersect the sliding direction. On the other hand, the rocking arm 26 is so supported at its root end on the sliding door 12 as to rock vertically and is biased upward by the torsional coil spring 32 which is mounted at the root end of the rocking arm 26, so that it is guided by the upper rail 14 while the roller 34 supported on the leading end of the rocking arm 26 being turned.

As a result, the sliding door 12 is slid when opened/closed while being guided by the upper rail 14. The component as curved to make an upward guidance is owned by the front portion of the upper rail 14 so that the rocking arm 26 is biased to follow that component by the torsional coil spring 32.

As a result, the upper rail 14 is always biased upward by the torsional coil spring 32 so that the roller 34 at the leading end of the rocking arm 26 follows the upper rail 14 to prevent a chatter therebetween. Since the front portion of the upper rail 14 is curved upward, the overhang of the roof head lining 24 into the compartment space S can be prevented to enlarge the compartment space S.

Figure 5:
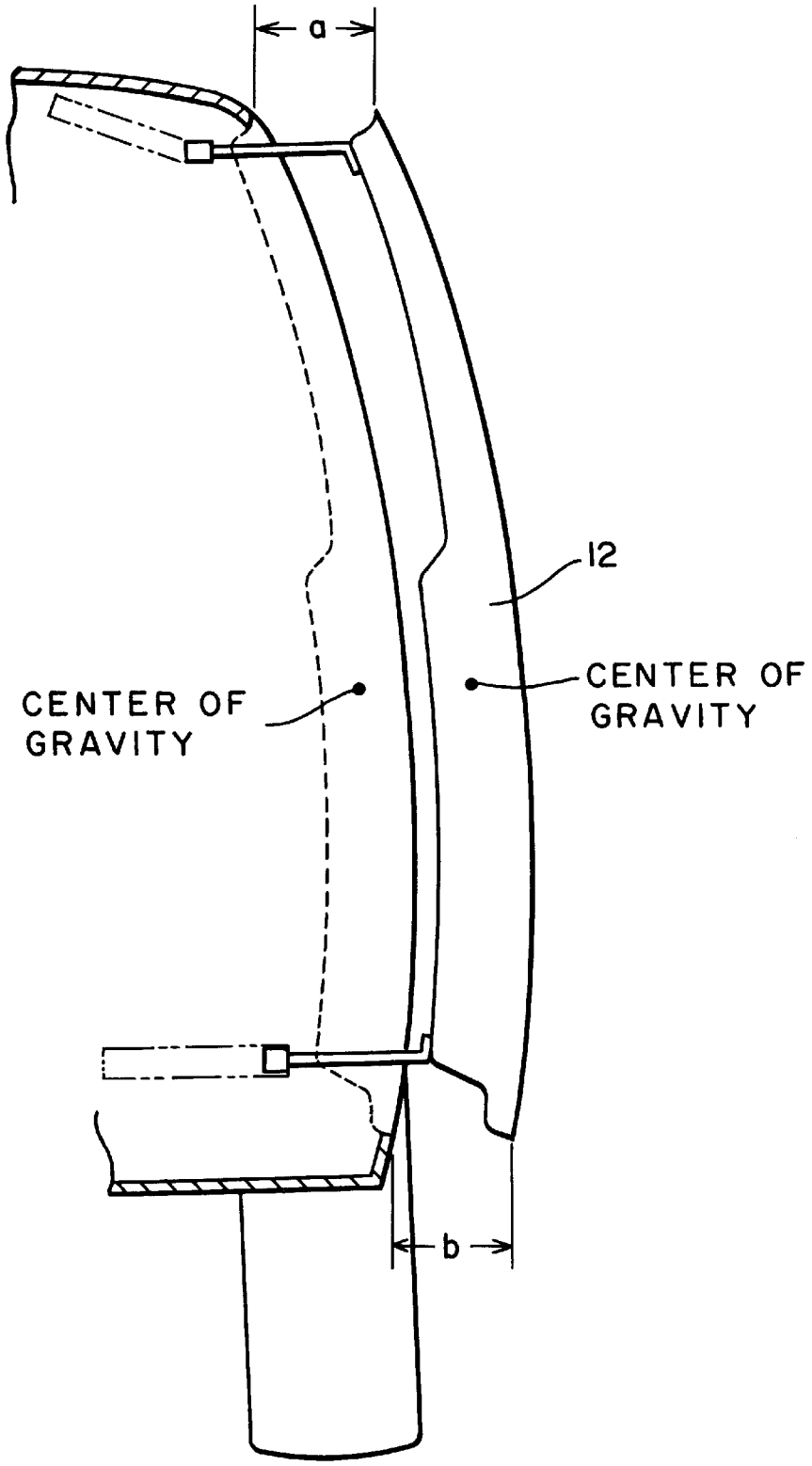
FIG. 5 is a diagram showing the opened state of the sliding door to which the sliding door opening/closing structure according to the embodiment of the invention is applied.

Since the front portion of the upper rail 14 is curved upward to prevent the overhang of the roof head lining 24 into the compartment space S, the curvature of the front portion of the upper rail 14 inward of the vehicle 20 can be made similar to that of the lower rail 18. As a result, the displacements (as indicated by a and b in FIG. 5) of the upper end and the lower end of the sliding door 12 widthwise of the vehicle are substantially equalized, as shown in FIG. 5. In other words, the sliding door 12 is moved generally in parallel, as viewed in the front elevation of the vehicle, so that the center of gravity of the sliding door 12 is not shifted upward. This can lighten the force for moving the sliding door 12.

In accordance with this, the roller 34 at the leading end of the rocking arm 26 follows the upper rail 14 to prevent the chatter therein. As a result, the height of the upper rail 14 can be reduced to prevent the overhang or projection of the roof head lining 24 into the compartment space S.

In the embodiment thus far described, the bias means is exemplified by the elastic member or the elastically deformable torsional coil spring, which can be replaced by another kind of spring such as a steel spring or an elastic material such as rubber.

According to this embodiment, as has been described hereinbefore, there is achieved an effect that the overhang of the guide rail such as the upper rail into the compartment space can be prevented to enlarge this space.

Moreover, the height of the upper rail can be reduced to prevent the overhang of the roof head lining into the compartment space.

A second embodiment of the invention will be described with reference to FIGS. 6 to 10. The description of the construction, as equivalent to that of the first embodiment of FIGS. 1 to 5, is omitted, but its equivalent components are designated in FIGS. 6 to 10 by the same reference numerals as used in FIGS. 1 to 5.

Figure 6:
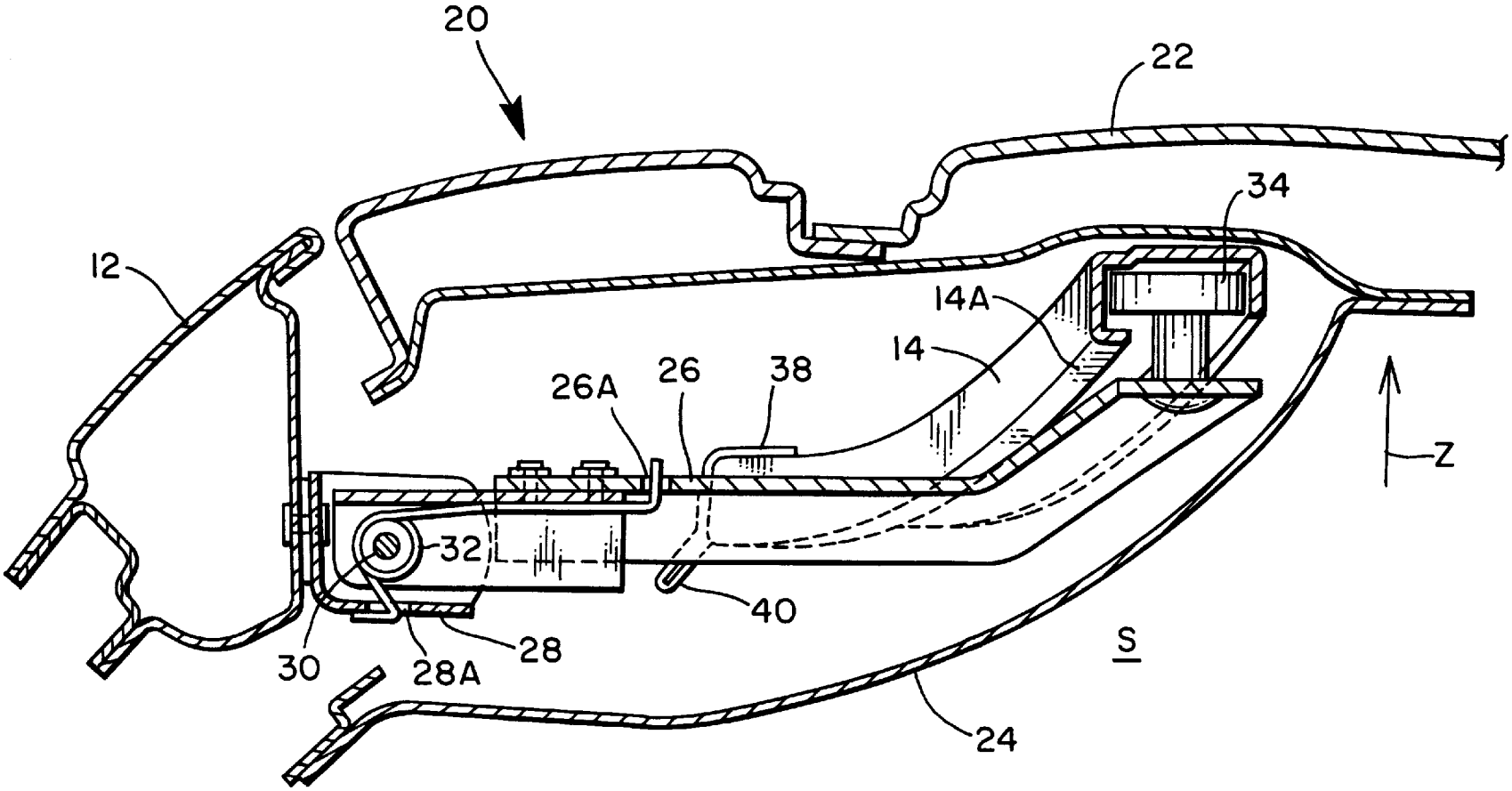
FIG. 6 is an enlarged section showing an assembled structure of a sliding door according to one embodiment of the invention.
Figure 10:
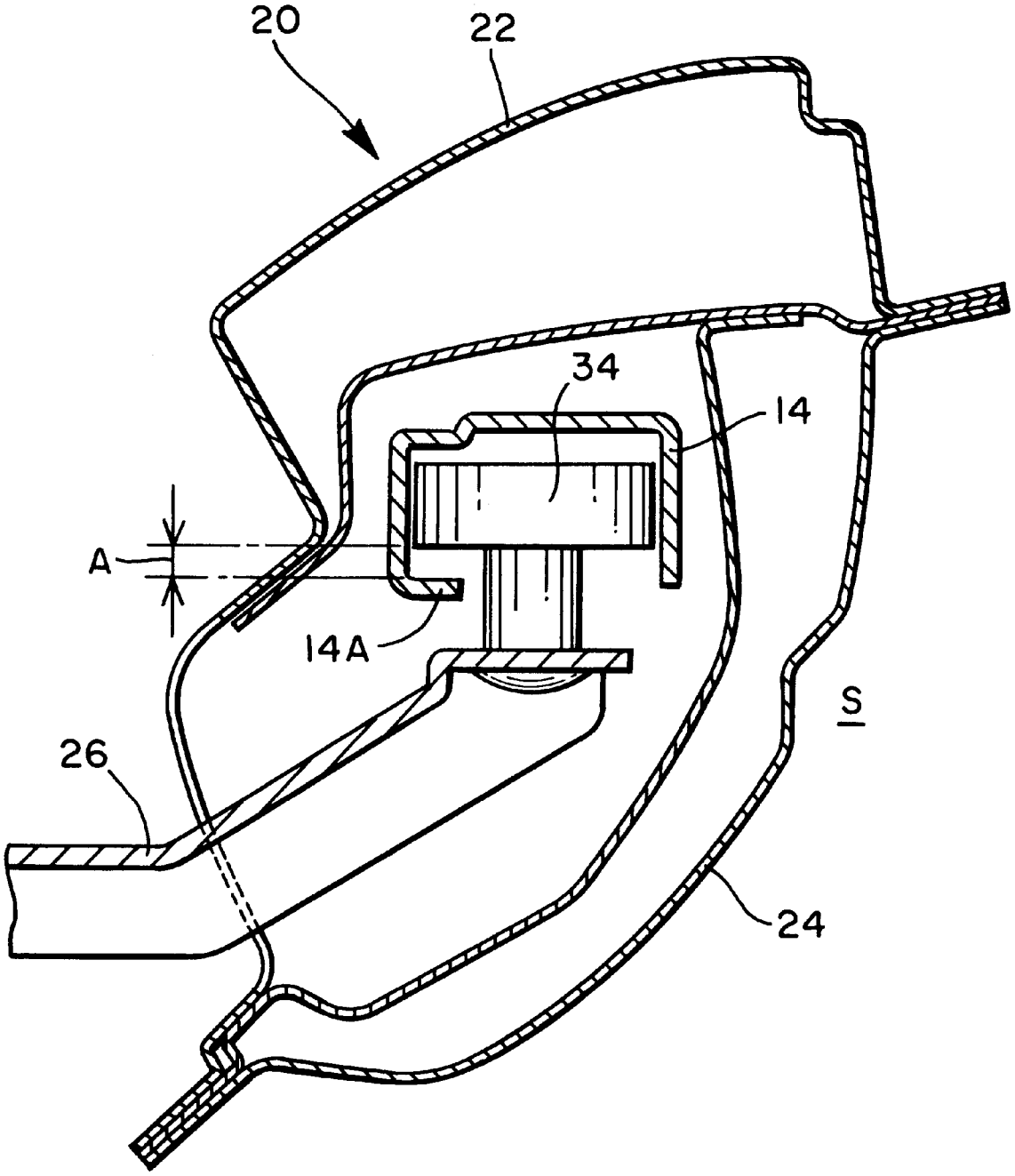
FIG. 10 is an enlarged section showing the assembled structure of the sliding door, as taken along line X—X of FIG. 7.
Figure 11:
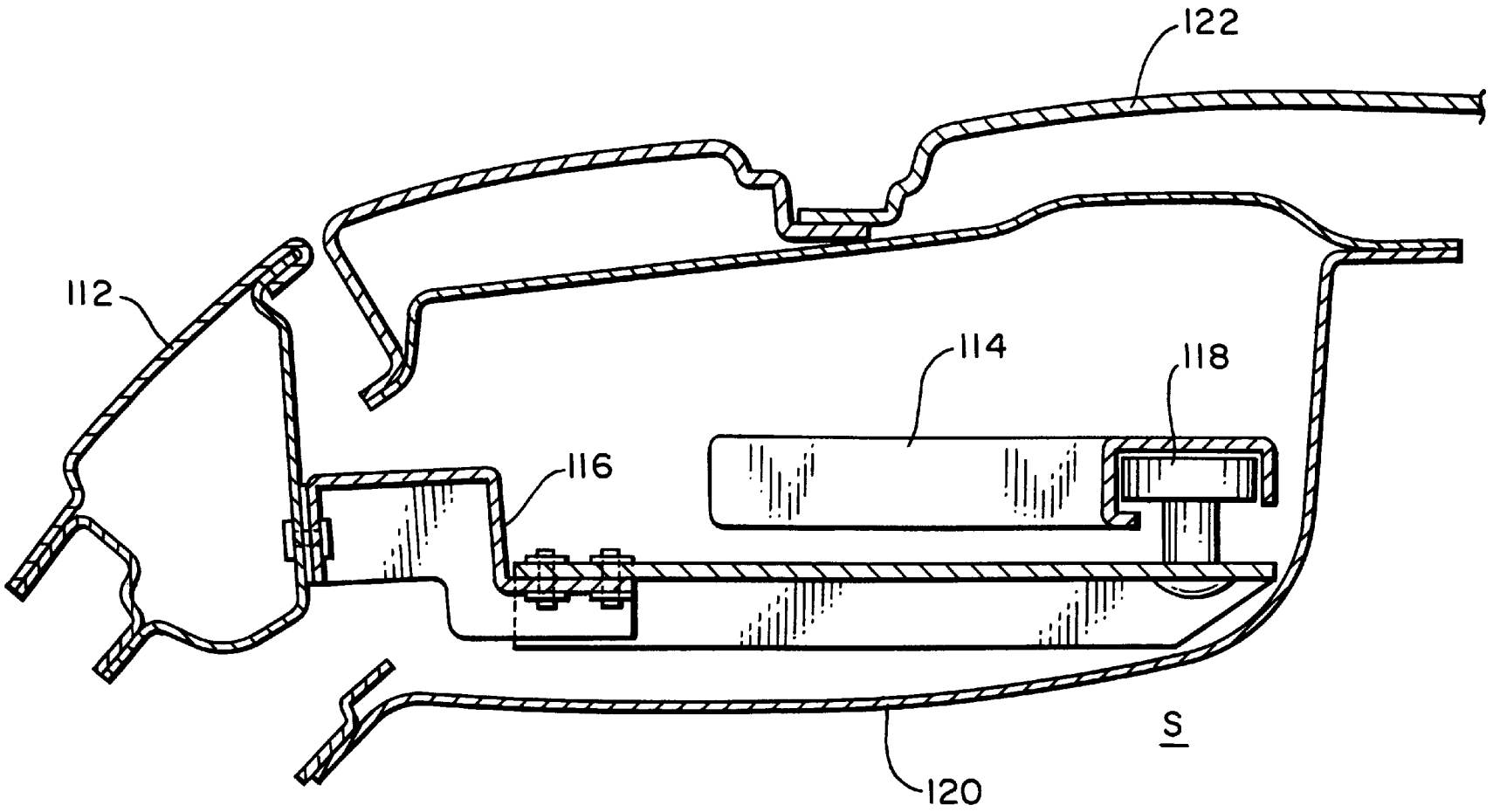
FIG. 11 PRIOR ART
FIG. 11 is an enlarged section showing an essential portion of an assembled structure of a sliding door according to the prior art.

At the leading end of the rocking arm 26, as shown in FIGS. 6 and 10, there is turnably supported the roller 34 which is slidably fitted in the upper rail 14 having a generally C-shaped cross section, so that the rocking arm 26 is guided at its leading end in slidable engagement with the upper rail 14.

In the lower portion of the upper rail 14 having the generally C-shaped section, more specifically, there is formed an engaging portion 14A which is extended inward of the upper rail 14 so that it engages with the lower face 34 of the roller 34, as fitted in the upper rail 14, to prevent the roller 34 from coming out from the upper rail 14.

Figure 7:
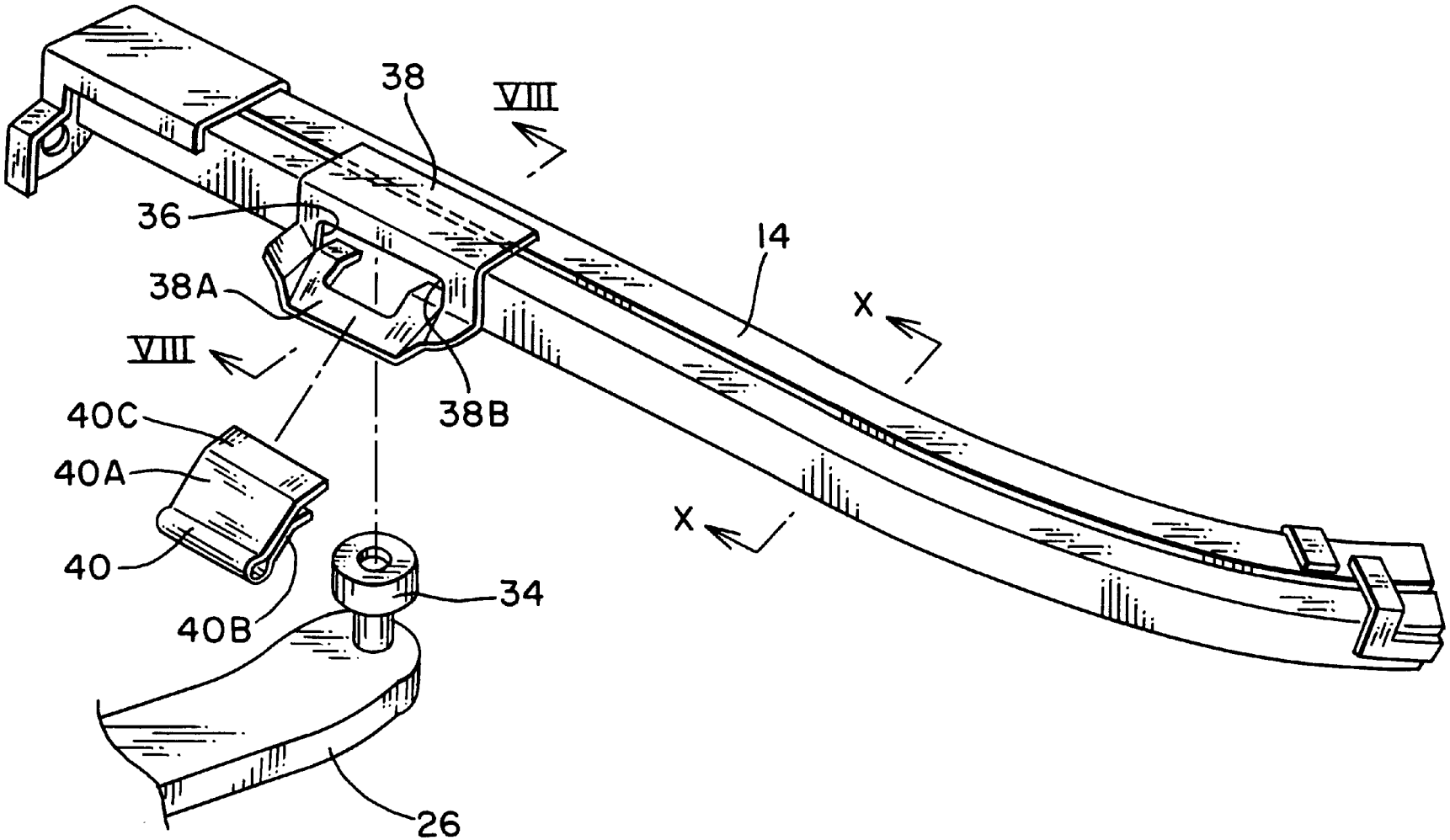
FIG. 7 is an exploded perspective view showing the assembled structure of the sliding door according to the embodiment of the invention.
Figure 8:
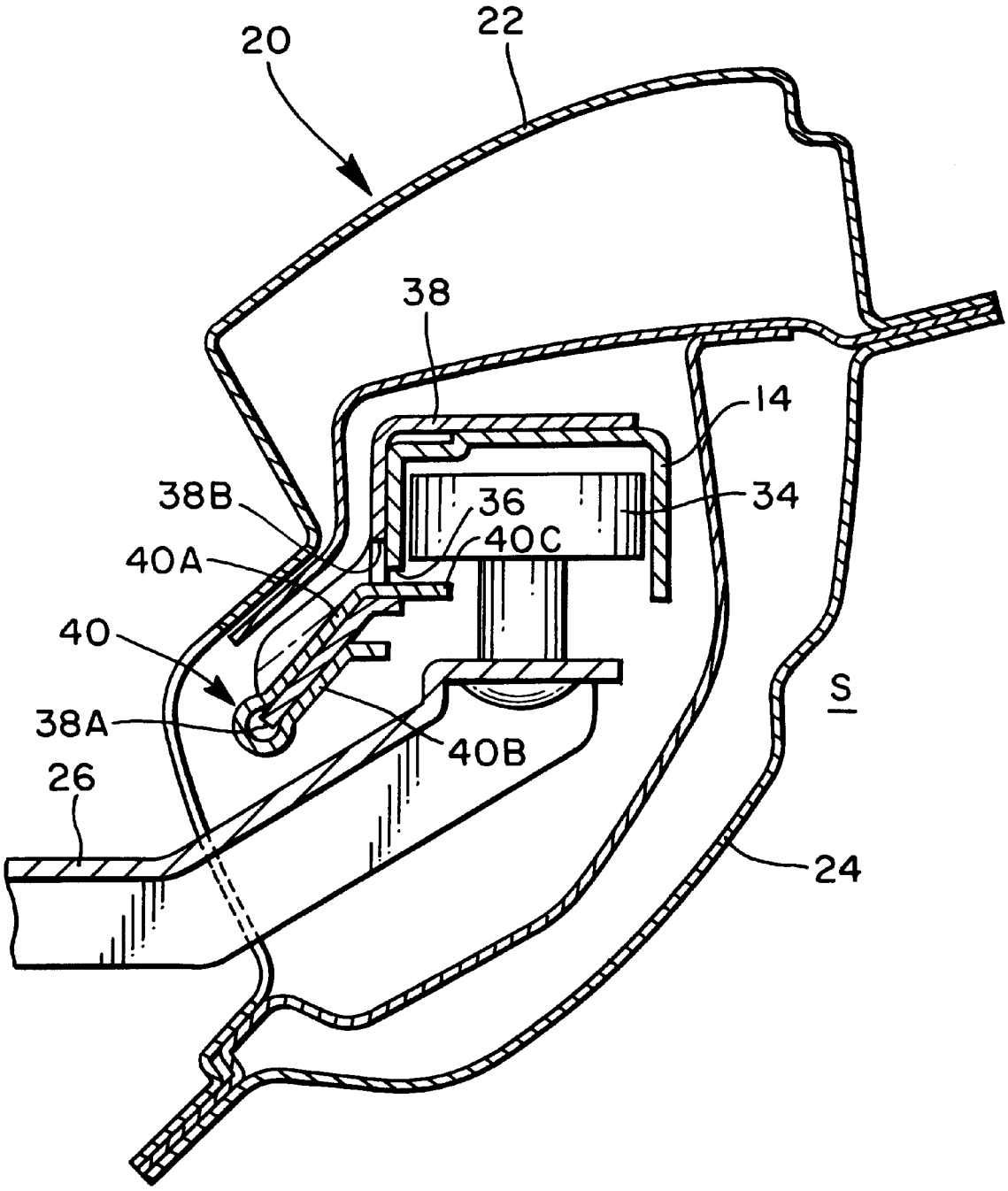
FIG. 8 is an enlarged section showing the assembled structure of the sliding door, as taken along line VIII—VIII of FIG. 7.

As shown in FIGS. 7 and 8, the upper rail 14 is cut off at its longitudinal midway. This cut-off portion provides a roller insert hole 36 or an opening to insert the roller 34. To the portion corresponding to the roller insert hole 36 of the upper rail 14, there is fixed or welded a bracket 38. This bracket 38 is provided at its central portion or a portion corresponding to the roller insert hole 36 with a clipped portion 38A which is formed into a U-shape to extend obliquely downward. The bracket 38 is further provided above the clipped portion 38A with a through hole 38B extending therethrough.

Figure 9:
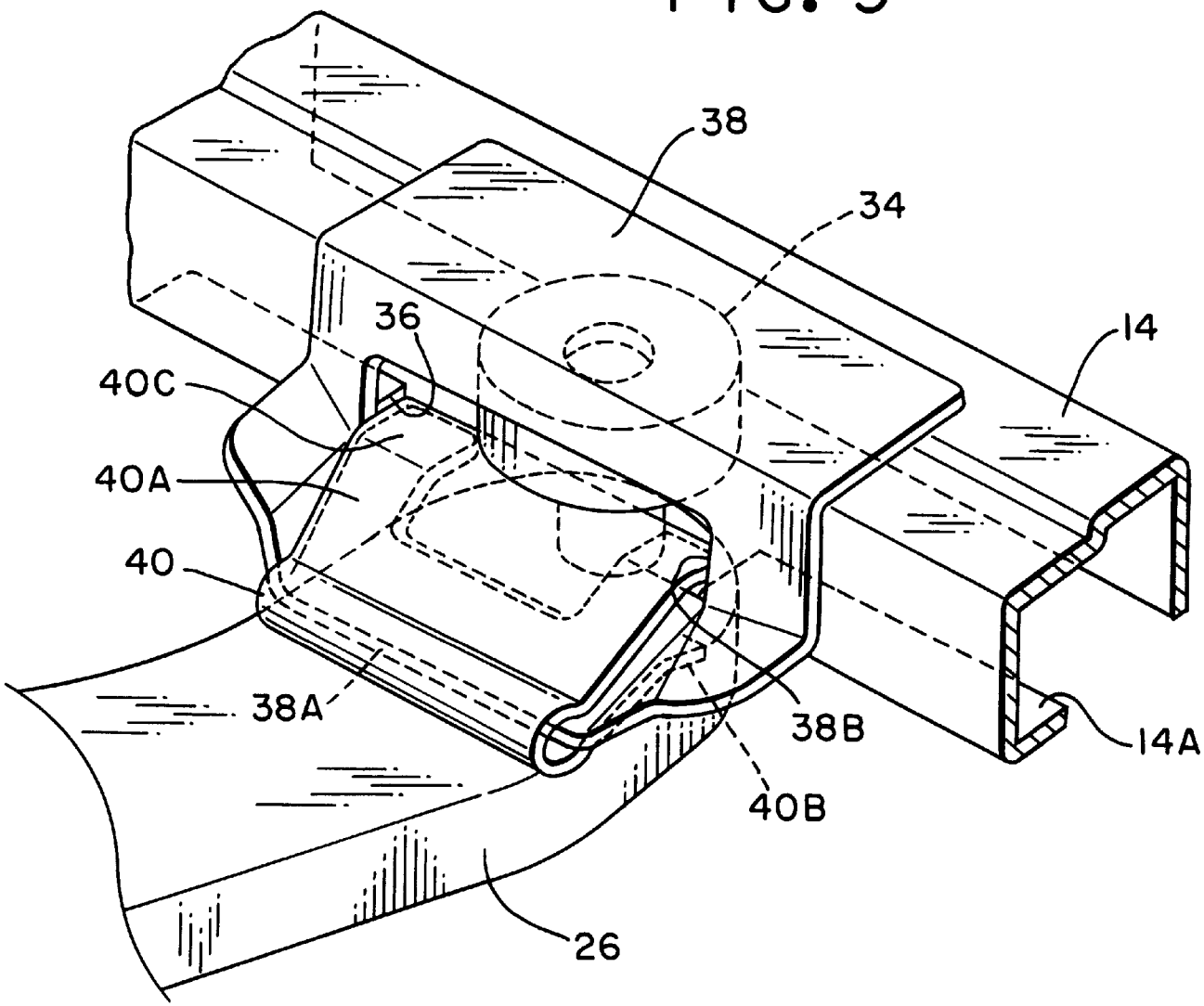
FIG. 9 is an enlarged perspective view showing an essential portion of the assembled structure of the sliding door according to one embodiment of the invention.

As shown in FIGS. 8 and 9, a pair of clipping members 40A and 40B forming a clip 40 clip that clipped portion 38A so that the clip 40 is fixed on the bracket 38. Moreover, the clipping member 40A or the upper one of the paired clipping members 40A and 40B is provided at its leading end with a removably engaging portion 40C which is bent to extend from the clipping member 40A.

Thus, the clip 40 is removably mounted on the upper rail 14 through the bracket 38, and its removably engaging portion 40C is protruded to below the roller 34 through the through hole 38B of the bracket 38 thereby to shut off the roller insert hole 36 of the upper rail 14.

Here will be described the work of inserting the roller 34 of the embodiment into the upper rail 14.

Since the portion on which the bracket 38 is fixed of the upper rail 14 is provided with the roller insert hole 36 by cutting it off, as shown in FIG. 7, the roller 34 can be inserted from that portion of the bracket 38 into the upper rail 14. The clip 40, as bent at its central portion to form the paired clipping members 40A and 40B in a contacting manner, is mounted on the bracket 38.

In other words, the clip 40 is so pushed onto the bracket 38 as to insert the clipped portion 38A of the bracket 38 into the clearance between the paired clipping members 40A and 40B. As a result, the clip 40 is mounted on the upper rail 14 through the bracket 38, as shown in FIGS. 8 and 9, thus ending the work of inserting the roller 34 into the upper rail 14.

The actions of this embodiment will be described.

The roller 34 is turnably supported at the leading end of the rocking arm 26 which is supported at its root end by the sliding door 12 to be slid when opened/closed with respect to the vehicle body. The upper rail 14, as extended in the sliding direction of the sliding door 12 for guiding the roller 34 while housing it, has the roller insert hole 36 for inserting the roller 34 therethrough, and the clip 40 for closing the roller insert hole 36 which is removably mounted with respect to the upper rail 14.

As a result, the roller 34 is inserted into the roller insert hole 36 of the upper rail 14 so that the sliding door 12 is slid when opened/closed with the roller 34 being guided by the upper rail 14. The roller insert hole 36 is shut off by mounting the clip 40 removably with respect to the upper rail 14.

Even with the construction of this embodiment, in which the height of the rail section is shortened to reduce a size A (as shown in FIG. 10) so as to increase the compartment space S by preventing the overhang of the roof head lining 24 of the housing of the upper rail 14 into the compartment space S and in which the rocking arm 26 can rock in the swinging manner, the roller insert hole 36 is shut off with the clip 40 after the roller 34 was inserted through the roller insert hole 36, so that the roller 34 can be prevented from coming out from the roller insert hole 36.

In short, the small member or the slip 40 is adopted so that the roller 34 can be prevented from coming out from the upper rail 14 while sparing the space. By this simple work of attaching the clip 40, the roller 34 can be prevented from coming out thereby to improve the workability and lower the production cost. At the time of a maintenance, the roller 34 can be replaced merely by removing the clip 40 thereby to improve the maintainability.

In the embodiment, the clip 40 is mounted on the upper rail 14 through the bracket 38, which may be eliminated to mount the clip 40 directly on the upper rail 14. Moreover, the arm is exemplified by the rocking arm 26 but may have a fixed structure of no rocking motion only in this embodiment.

Thus, according to the invention, there can be achieved the effect that the roller can be prevented from coming out from the guide rail while sparing the space.

As many apparently widely different embodiments of the present invention can be made without departing from the spirit and scope thereof, it is to be understood that the invention is not limited to the specific embodiments thereof except as defined in the appended claims.

What is claimed is:

1. A sliding door structure, comprising:

a sliding door;

a guide rail having a front end portion and extending in a sliding direction of said sliding door, said front end portion being curved upward for guiding said sliding door upward, said guide rail being securable to a body of a vehicle;

a rocking arm having a root end and a leading end, said root end being rotatably connected to said sliding door;

an elastic device mounted at the root end of said rocking arm which biases said rocking arm upward; and a roller supported at the leading end of said rocking arm and being guided by said guide rail.

2. A sliding door structure according to claim 1, wherein the front end portion of said guide rail for guiding the sliding door upward is configured to assist in enlarging a compartment space and to prevent projection of a roof head lining for the inside of the vehicle body toward the compartment space.

3. A sliding door structure according to claim 1, wherein said elastic device includes a coil spring.

4. A sliding door structure for a vehicle body, comprising:

a sliding door adapted to slide when opened or closed with respect to a vehicle body;

a roller supported on said sliding door;

a guide rail extending in a sliding direction of said sliding door for guiding and housing said roller, said guide rail having an insert opening receiving said roller, said guide rail being securable to the vehicle body; and a clip removably mounted on said guide rail for shutting off the insert opening of said guide rail.

5. A sliding door structure comprising:

a sliding door adapted to slide when opened or closed with respect to a vehicle body;

an arm having a leading end and a root end, said root end being supported by said sliding door;

a roller supported at the leading end of said arm;

a guide rail extending in a sliding direction of said sliding door for guiding and housing said roller, said guide rail having an insert opening receiving said roller, said guide rail being securable to the vehicle body; and a clip removably mounted on said guide rail for shutting off the insert opening of said guide rail.

6. A sliding door structure according to claim 5, wherein said clip has a pair of clipping members which clip a member formed on said guide rail.

7. A sliding door structure according to claim 6, wherein said guide rail is provided with a bracket having said member, said clip being removably mounted on said bracket.

8. A sliding door structure for opening or closing a sliding door for a vehicle, comprising:

a guide rail extending in a sliding direction of said sliding door and having a curved component for guiding said sliding door in a direction that intersects the sliding direction, said guide rail being securable to a body of the vehicle, said guide rail having an insert opening receiving said roller;

a rocking arm having a leading end and a root end, said root end being rotatable supported on said sliding door, said leading end of said rocking arm being guided by said guide rail;

bias means biasing said rocking arm; and clip means removably mounted on said guide rail for closing the insert opening of said guide rail.

* * * * *